US010421113B2

(12) United States Patent
Nakamura et al.

(10) Patent No.: US 10,421,113 B2
(45) Date of Patent: Sep. 24, 2019

(54) FORMED MATERIAL MANUFACTURING METHOD AND SURFACE TREATED METAL PLATE USED IN SAME

(71) Applicant: NISSHIN STEEL CO., LTD., Tokyo (JP)

(72) Inventors: Naofumi Nakamura, Sakai (JP); Yudai Yamamoto, Sakai (JP); Jun Kurobe, Sakai (JP)

(73) Assignee: NIPPON STEEL NISSHIN CO., LTD., Tokyo (JP)

( * ) Notice: Subject to any disclaimer, the term of this patent is extended or adjusted under 35 U.S.C. 154(b) by 247 days.

(21) Appl. No.: 15/104,309

(22) PCT Filed: Oct. 23, 2014

(86) PCT No.: PCT/JP2014/078212
§ 371 (c)(1),
(2) Date: Jun. 14, 2016

(87) PCT Pub. No.: WO2015/093145
PCT Pub. Date: Jun. 25, 2015

(65) Prior Publication Data

US 2016/0311006 A1 Oct. 27, 2016

(30) Foreign Application Priority Data

Dec. 17, 2013 (JP) ..... 2013-260072

(51) Int. Cl.
*B21D 22/28* (2006.01)
*B21D 51/10* (2006.01)
*C23C 2/06* (2006.01)

(52) U.S. Cl.
CPC ..... *B21D 22/286* (2013.01); *B21D 22/28* (2013.01); *B21D 51/10* (2013.01); *C23C 2/06* (2013.01)

(58) Field of Classification Search
CPC ..... B21D 22/025; B21D 22/20; B21D 22/28; B21D 22/286; B21D 22/30; B21D 51/10
See application file for complete search history.

(56) References Cited

U.S. PATENT DOCUMENTS 5,179,854 A 1/1993 Matsui et al.
5,778,722 A * 7/1998 Saiki ..... B21D 22/28 72/347

(Continued)

FOREIGN PATENT DOCUMENTS

CN 1436122 A 8/2003
CN 1613986 A 5/2005

(Continued)

OTHER PUBLICATIONS

International Search Report cited in PCT/JP2014/078212 dated Nov. 10, 2014, 2 pages.

(Continued)

*Primary Examiner* — Pradeep C Battula
(74) *Attorney, Agent, or Firm* — Rothwell, Figg, Ernst & Manbeck, P.C.

(57) ABSTRACT

A formed material manufacturing method according to present invention includes the steps of forming a convex formed portion by performing at least one forming process on a surface treated metal plate, and performing ironing on the formed portion using an ironing mold after forming the formed portion. The ironing mold includes a punch that is inserted into the formed portion, and a die having a pushing hole into which the formed portion is pushed together with the punch. An inner peripheral surface of the pushing hole extends non-parallel to an outer peripheral surface of the punch, and the inner peripheral surface is provided with a clearance that corresponds to an uneven plate thickness distribution, in the pushing direction, of the formed portion prior to the ironing relative to the outer peripheral surface to (Continued)

ensure that an amount of ironing applied to the formed portion remains constant in the pushing direction.

3 Claims, 7 Drawing Sheets

(56) References Cited

U.S. PATENT DOCUMENTS

| | | | |
|---|---|---|---|
| 6,465,114 | B1 | 10/2002 | Honda et al. |
| 2009/0039737 | A1 | 2/2009 | Kawada et al. |
| 2009/0113976 | A1 | 5/2009 | Tomaru et al. |
| 2015/0072166 | A1 | 3/2015 | Nakano et al. |
| 2016/0001349 | A1 | 1/2016 | Nakamura et al. |

FOREIGN PATENT DOCUMENTS

| | | | |
|---|---|---|---|
| CN | 101304825 | A | 11/2008 |
| CN | 104411424 | A | 3/2015 |
| EP | 0 664 169 | A1 | 7/1995 |
| JP | 63-97316 | A | 4/1988 |
| JP | 2-303634 | A | 12/1990 |
| JP | H04289190 | A | 10/1992 |
| JP | 5-4300 | A | 1/1993 |
| JP | H0550151 | A | 3/1993 |
| JP | 9-295071 | A | 11/1997 |
| JP | 63-132728 | A | 6/1998 |
| JP | 2002-371333 | A | 12/2002 |
| JP | 2009-44599 | A | 2/2009 |
| JP | 5395301 | B1 | 1/2014 |
| KR | 10-2000-0033739 | A | 6/2000 |
| WO | 2013/160973 | A1 | 10/2013 |

OTHER PUBLICATIONS

Chinese communication cited in 201480069522.5 dated Jun. 20, 2017, 5 pages.

Office Action issued for Chinese Patent Application No. 201480069522.5 dated Jan. 26, 2018, 5 pages.

Communication issued for European Patent Application No. 14 871 623.6 dated Mar. 4, 2019, 5 pages.

Office Action issued for Australian Patent Application No. 2017202758 dated Apr. 9, 2019, 4 pages.

Office Action issued for Chinese Patent Application No. 200811171646.0 dated May 22, 2019, 6 pages.

Office Action issued for Philippine patent Application No. 1/2018/501835 dated Jun. 25, 2019, 4 pages.

Office Action issued for Korean Patent Application No. 10-2016-7014140 dated Aug. 5, 2019, 5 pages.

* cited by examiner

FORMED MATERIAL MANUFACTURING METHOD AND SURFACE TREATED METAL PLATE USED IN SAME

CROSS REFERENCE TO RELATED APPLICATION

This application is a 35 U.S.C. 371 National Phase Entry Application from PCT/JP2014/078212, filed Oct. 23, 2014, which claims the benefit of Japanese Patent Application No. 2013-260072 filed Dec. 17, 2013, the disclosure of which are incorporated by reference in their entirety.

TECHNICAL FIELD

Present invention relates to a formed material manufacturing method in which ironing is performed on a formed portion, and a surface treated metal plate used therein.

BACKGROUND ART

A convex formed portion is typically formed by performing a pushing process such as drawing using a surface treated metal plate such as a coated steel plate as a raw material. When the formed portion requires a particularly high degree of dimensional precision, ironing is implemented on the formed portion after the formed portion is formed. Ironing is a processing method of setting a clearance between a punch and a die to be narrower than a plate thickness of the formed portion prior to ironing, and then ironing a plate surface of the formed portion using the punch and the die so that the plate thickness of the formed portion matches the clearance between the punch and the die.

A configuration disclosed in Patent Document 1 and so on, shown below, for example, may be employed as a mold used during ironing. Specifically, the conventional mold includes a punch and a die. The punch is a columnar member having an outer peripheral surface that extends rectilinearly parallel to a pushing direction into a pushing hole, and is inserted into a formed portion. The die includes the pushing hole into which the formed portion is pushed together with the punch. The pushing hole has a shoulder portion disposed on an outer edge of an inlet of the pushing hole and constituted by a curved surface having a predetermined curvature radius, and an inner peripheral surface that extends rectilinearly from a radius end of the shoulder portion parallel to the pushing direction. When the formed portion is pushed into the pushing hole, the plate surface thereof is ironed by the shoulder portion so as to decrease gradually in thickness to a width of a clearance between the outer peripheral surface of the punch and the inner peripheral surface of the pushing hole.

CITATION LIST

Patent Literature

[PTL 1]
Japanese Patent Application Publication H5-50151

SUMMARY OF INVENTION

The plate thickness of the formed portion prior to ironing is uneven in the pushing direction. More specifically, the plate thickness of a rear end side of the formed portion in the pushing direction is often thicker than the plate thickness of a tip end side of the formed portion. The reason why the rear end side is thicker is that when the formed portion is formed, the tip end side is stretched to a greater extent than the rear end side.

In the conventional mold described above, the outer peripheral surface of the punch and the inner peripheral surface of the pushing hole extend parallel to each other. Accordingly, the clearance between the outer peripheral surface of the punch and the inner peripheral surface of the pushing hole is uniform in the pushing direction, and therefore the part of the formed portion having the increased plate thickness is subjected to a larger amount of ironing. Hence, a surface treated layer of the part having the increased plate thickness is shaved, and as a result, a powder form residue may be generated. The powder form residue causes problems such as formation of minute pockmarks (dents) in the surface of the ironed formed portion and deterioration of the performance of a product manufactured using the formed material.

Present invention has been designed to solve the problem described above, and an object thereof is to provide a formed material manufacturing method and a surface treated metal plate used therein, with which generation of a large load on a part of a surface can be avoided so that an amount of generated powder form residue can be reduced.

Solution to Problem

A formed material manufacturing method according to present invention includes the steps of: forming a convex formed portion by performing at least one forming process on a surface treated metal plate; and performing ironing on the formed portion using an ironing mold after forming the formed portion. The surface treated metal plate includes a surface treated layer provided on a surface of the metal plate, and a lubricating film provided on a surface of the surface treated layer. The ironing mold includes a punch that is inserted into the formed portion, and a die having a pushing hole into which the formed portion is pushed together with the punch. The pushing hole includes a shoulder portion disposed on an outer edge of an inlet of the pushing hole and constituted by a curved surface having a predetermined curvature radius, and an inner peripheral surface which extends from a radius end of the shoulder portion in a pushing direction of the formed portion, and along which an outer surface of the formed portion slides in response to relative displacement between the punch and the die. The inner peripheral surface extends non-parallel to an outer peripheral surface of the punch, and the inner peripheral surface is provided with a clearance that corresponds to an uneven plate thickness distribution, in the pushing direction, of the formed portion prior to the ironing relative to the outer peripheral surface to ensure that an amount of ironing applied to the formed portion remains constant in the pushing direction.

Further, a surface treated metal plate according to present invention is used in a formed material manufacturing method including the steps of forming a convex formed portion by performing at least one forming process on the surface treated metal plate, and performing ironing on the formed portion using an ironing mold after forming the formed portion, and includes a surface treated layer provided on a surface of the metal plate and a lubricating film provided on a surface of the surface treated layer.

Advantageous Effects of Invention

With the formed material manufacturing method according to the present invention, the inner peripheral surface of the pushing hole extends non-parallel to the outer peripheral surface of the punch, and the inner peripheral surface is provided with a clearance that corresponds to the uneven plate thickness distribution, in the pushing direction, of the formed portion prior to the ironing relative to the outer peripheral surface to ensure that the amount of ironing applied to the formed portion remains constant in the pushing direction. Therefore, generation of a large load on a part of the surface can be avoided, and as a result, an amount of generated powder form residue can be reduced. In particular, the surface treated metal plate includes the surface treated layer provided on the surface of the metal plate and the lubricating film provided on the surface of the surface treated layer, and therefore the amount of generated powder form residue can be reduced under a wider range of processing conditions.

DESCRIPTION OF EMBODIMENTS

Embodiments of the present invention will be described below with reference to the drawings.

First Embodiment

Figure 1:
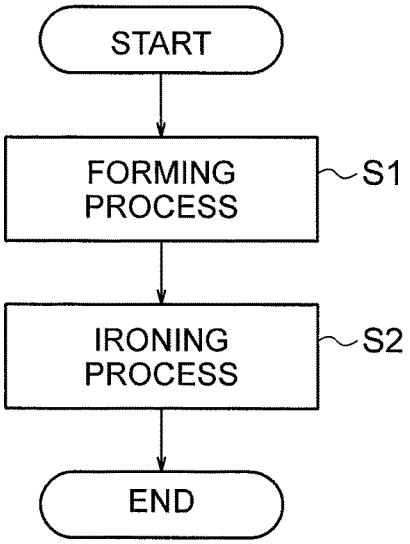
FIG. 1 is a flowchart showing a formed material manufacturing method according to an embodiment of the present invention.
Figure 2:
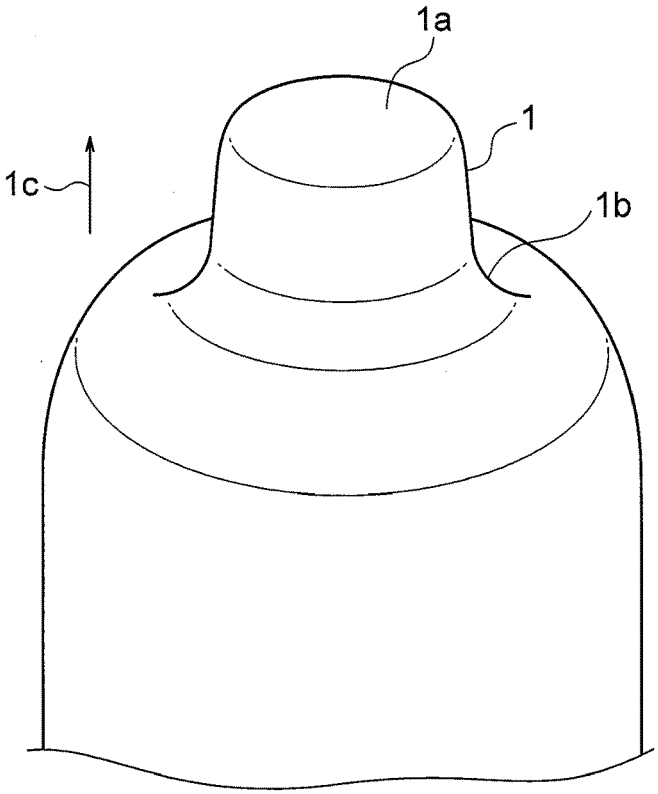
FIG. 2 is a perspective view showing a formed material including a formed portion formed by a forming process shown in FIG. 1.
Figure 3:
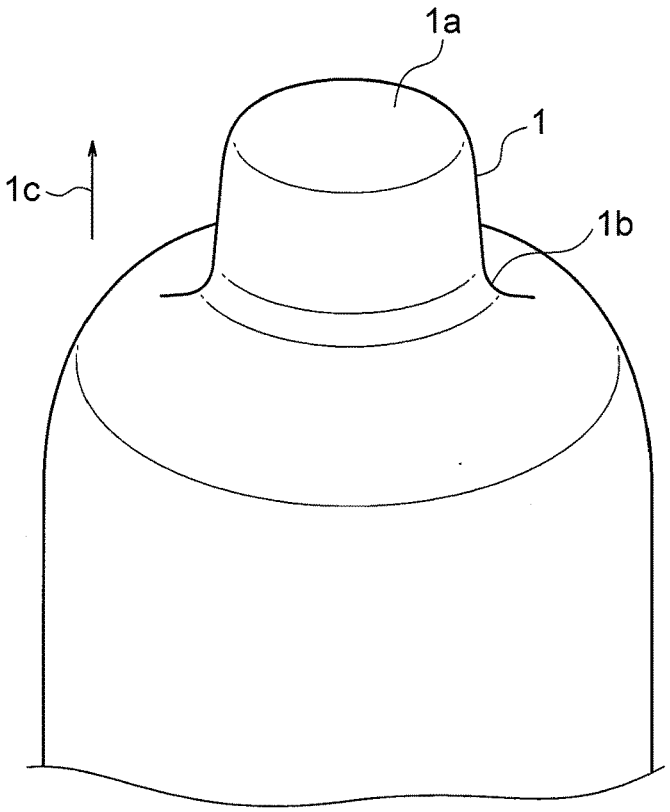
FIG. 3 is a perspective view showing the formed material including the formed portion following an ironing process shown in FIG. 1.

FIG. 1 is a flowchart showing a formed material manufacturing method according to an embodiment of the present invention. FIG. 2 is a perspective view showing a formed material including a formed portion 1 formed by a forming process S1 shown in FIG. 1. FIG. 3 is a perspective view showing the formed material including the formed portion 1 following an ironing process S2 shown in FIG. 1.

As shown in FIG. 1, the formed material manufacturing method according to this embodiment includes the forming process S1 and the ironing process S2. The forming process S1 is a process for forming the formed portion 1 (see FIG. 2) in a convex shape by performing at least one forming process on a surface treated metal plate. The forming process includes a pressing process such as drawing or stretching. The surface treated metal plate includes a surface treated layer provided on a surface of the metal plate, and a lubricating film provided on a surface of the surface treated layer. The surface treated layer includes a coating film or a coating layer. The lubricating film is a resin coating film formed by dispersing a compound of polyethylene-fluorine resin particles over the surface of the surface treated layer as a lubricant, the polyethylene-fluorine resin particles being obtained by bonding fine fluorine resin powder to the particle surface of polyethylene resin powder and polyethylene resin particles, for example. In this embodiment, the surface treated metal plate will be described as a Zn (zinc) coated steel plate obtained by applying a Zn coating to the surface of a steel plate and then forming the lubricating film on the surface of the coating layer.

As shown in FIG. 2, the formed portion 1 according to this embodiment is a convex portion formed by forming the Zn coated steel plate into a cap body and then forming an apex portion of the cap body to project further therefrom. Hereafter, a direction extending from a base portion 1*b* to an apex portion 1*a* of the formed portion 1 will be referred to as a pushing direction 1*c*. The pushing direction 1*c* is a direction in which the formed portion 1 is pushed into a pushing hole (see FIG. 5) provided in a die of an ironing mold to be described below.

The ironing process S2 is a process for performing ironing on the formed portion 1 using the ironing mold to be described below. Ironing is a processing method of setting a clearance between a punch and a die of an ironing mold to be narrower than a plate thickness of a formed portion prior to ironing, and then ironing a plate surface of the formed portion using the punch and the die so that the plate thickness of the formed portion matches the clearance between the punch and the die. In other words, the thickness of the formed portion 1 following ironing is thinner than the thickness of the formed portion 1 prior to ironing.

As shown in FIG. 3, by performing ironing, a curvature radius of a curved surface constituting an outer surface of the base portion 1*b* of the formed portion 1 is reduced. A formed material manufactured by performing the forming process S1 and the ironing process S2, or in other words a formed material manufactured using the formed material manufacturing method according to this embodiment, can be used in various applications, but is used in particular in an application as a motor case or the like, for example, in which the formed portion 1 requires a high degree of dimensional precision.

Figure 4:
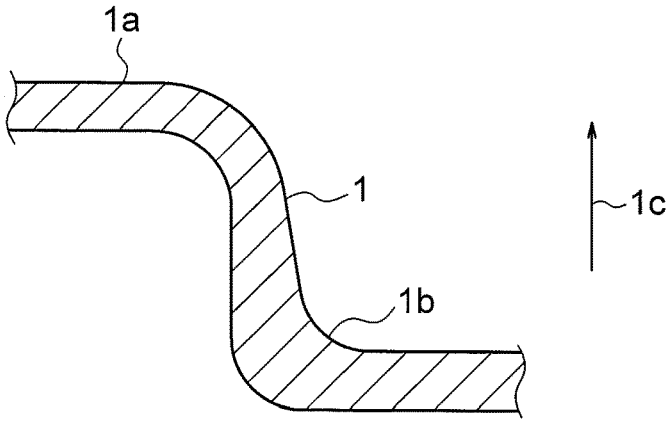
FIG. 4 is a sectional view of a formed portion 1 shown in FIG. 2.

FIG. 4 is a sectional view showing the formed portion 1 of FIG. 2. As shown in FIG. 4, the plate thickness of the formed portion 1 prior to ironing is uneven in the pushing direction 1*c*. More specifically, the plate thickness on the base portion 1*b* side of the formed portion 1 in the pushing direction 1*c* is thicker than the plate thickness on the apex portion 1*a* side of the formed portion 1. In other words, the plate thickness of the formed portion 1 decreases gradually in the pushing direction 1*c* from a rear end side (the base portion 1*b* side) toward a tip end side (the apex portion 1*a* side). The reason for this uneven plate thickness distribution is that when the formed portion is formed in the forming process S1, the apex portion 1*a* side is stretched to a greater extent than the base portion 1*b* side. Note that a plate thickness reduction rate may be constant or uneven in the pushing direction 1*c*. The reduction rate is a value obtained by dividing a difference between a plate thickness $t_1$ in a predetermined position and a plate thickness $t_2$ in a position removed from the predetermined position by a unit distance d toward the tip end side by the unit distance d ($=(t_2-t_1)/d$).

Figure 5:
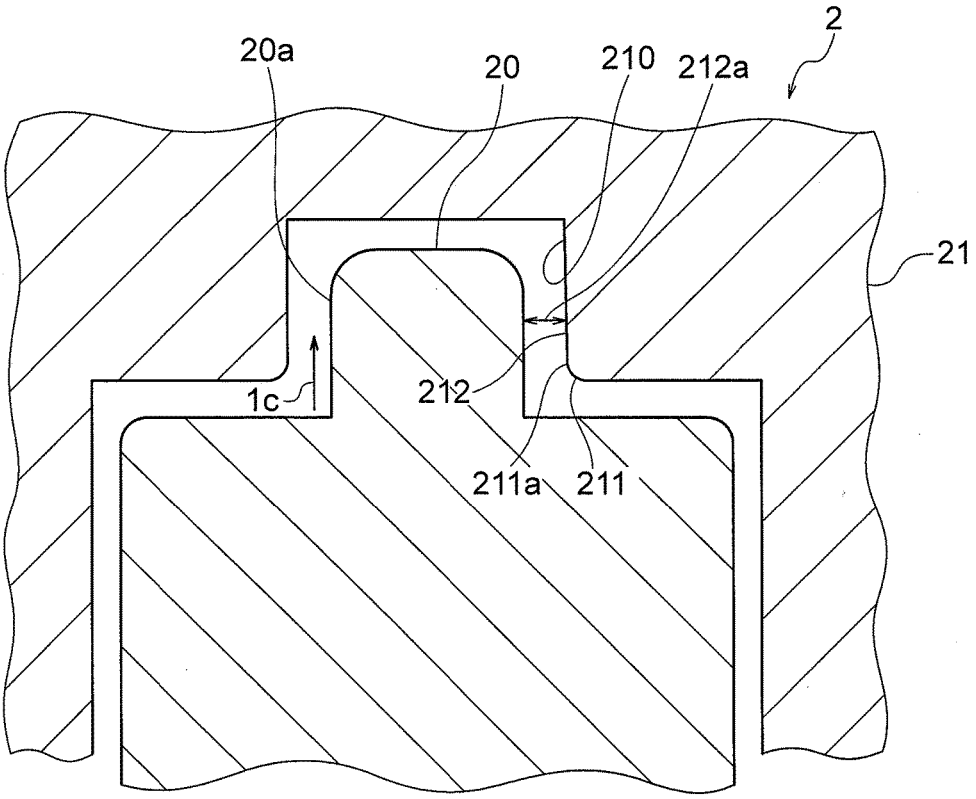
FIG. 5 is a sectional view showing an ironing mold used in the ironing process S2 shown in FIG. 1.
Figure 6:
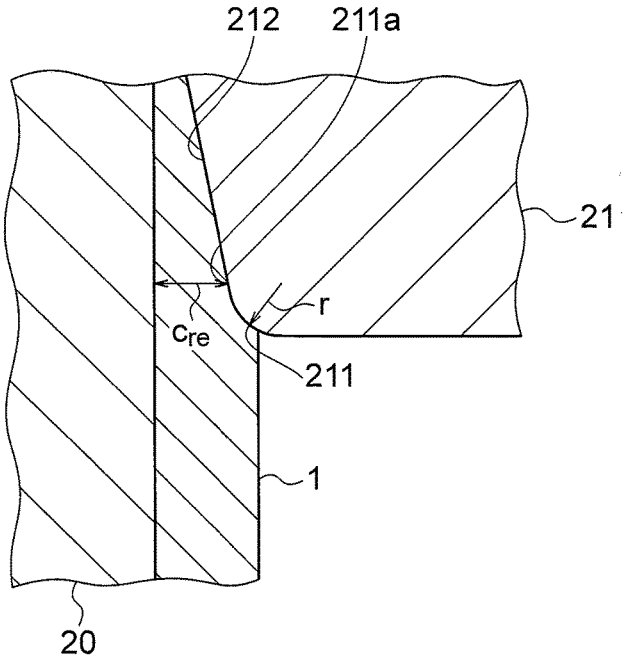
FIG. 6 is an enlarged illustrative view showing a periphery of a shoulder portion during the ironing process performed on the formed portion using the ironing mold shown in FIG. 5.

FIG. 5 is a sectional view showing an ironing mold 2 used in the ironing process S2 shown in FIG. 1, and FIG. 6 is an enlarged illustrative view showing a periphery of a shoulder portion 211 during the ironing process performed on the formed portion using the ironing mold 2 shown in FIG. 5. In FIG. 5, the ironing mold 2 includes a punch 20 and a die 21. The punch 20 is a convex body that is inserted into the formed portion 1 described above. An outer peripheral surface 20*a* of the punch 20 extends rectilinearly parallel to the pushing direction 1*c* into a pushing hole 210.

The die 21 is a member that includes the pushing hole 210 into which the formed portion 1 is pushed together with the punch 20. The pushing hole 210 includes the shoulder portion 211 and an inner peripheral surface 212. The shoulder portion 211 is disposed on an outer edge of an inlet of the pushing hole 210, and is constituted by a curved surface having a predetermined curvature radius. The inner peripheral surface 212 is a wall surface extending in the pushing direction 1*c* from a radius end 211*a* of the shoulder portion 211. The radius end 211*a* of the shoulder portion 211 is a terminal end of the curved surface constituting the shoulder portion 211 on an inner side of the pushing hole 210. The point that the inner peripheral surface 212 extends in the pushing direction 1*c* means that a component of the pushing direction 1*c* is included in an extension direction of the inner peripheral surface 212. As will be described in more detail below, the inner peripheral surface 212 of the pushing hole 210 extends non-parallel (does not extend parallel) to the outer peripheral surface 20*a* of the punch 20.

When the formed portion 1 is pushed into the pushing hole 210 together with the punch 20, as shown in FIG. 6, a plate surface of the formed portion 1 is ironed by the shoulder portion 211. Further, an outer surface of the formed portion 1 slides along the inner peripheral surface 212 in response to relative displacement between the punch 20 and the die 21. In the ironing mold 2 according to this embodiment, as described above, the inner peripheral surface 212 extends non-parallel to the outer peripheral surface 20*a* of the punch 20, and therefore the inner peripheral surface 212 also irons (thins) the plate surface of the formed portion 1.

To ensure that an amount of ironing applied to the formed portion 1 remains constant in the pushing direction 1*c*, the inner peripheral surface 212 is provided with a clearance 212*a* that corresponds to the uneven plate thickness distribution, in the pushing direction 1*c*, of the formed portion 1 prior to ironing relative to the outer peripheral surface 20*a* of the punch 20. Here, as shown in FIG. 5, the clearance 212*a* is a clearance between the inner peripheral surface 212 and the outer peripheral surface 20*a* at a point where the punch 20 is pushed into the pushing hole 210 up to a completion position of the ironing. The ironing amount is a difference between a pre-ironing plate thickness $t_b$ and a post-ironing plate thickness $t_a$ ($=t_b-t_a$).

In other words, the inner peripheral surface 212 is provided such that the clearance 212*a* relative to the outer peripheral surface 20*a* in any position in the pushing direction 1*c* takes a value obtained by subtracting a fixed value (the required ironing amount) from the plate thickness of the formed portion 1 prior to ironing in an identical position. When the clearance 212*a* in any position in the pushing direction 1*c* is set as C (d), the plate thickness of the formed portion 1 prior to ironing in the same position is set as $T_b$ (d), and the required ironing amount is set as A, the inner peripheral surface 212 is provided to satisfy C (d)=$T_b$ (d)−A. Note that d is the distance from the base portion 1*b* of the formed portion 1 in the pushing direction 1*c*.

To put it another way, the inner peripheral surface 212 is provided such that the clearance 212*a* between the inner peripheral surface 212 and the outer peripheral surface 20*a* decreases in the pushing direction 1*c* at an identical rate to the reduction rate of the plate thickness of the formed portion 1 in the pushing direction 1*c* prior to ironing. When the reduction rate of the plate thickness of the formed portion 1 in the pushing direction 1*c* prior to ironing is constant, the inner peripheral surface 212 is constituted by a rectilinear tapered surface that extends at an angle corresponding to the reduction rate of the plate thickness of the formed portion 1. When the reduction rate of the plate thickness of the formed portion 1 in the pushing direction 1*c* prior to ironing is uneven, on the other hand, the reduction rate of the plate thickness of the formed portion 1 is approximated to a fixed value, and the inner peripheral surface 212 is formed as a tapered surface that extends at an angle corresponding to the approximated value.

By forming the inner peripheral surface 212 in this manner, a load exerted on the surface of the formed portion 1 by the ironing process can be made uniform in the pushing direction 1*c* even when the plate thickness distribution of the formed portion 1 in the pushing direction 1*c* is uneven. As a result, generation of a large load on a part of the surface can be avoided so that the amount of generated powder form residue (coating residue and the like) can be reduced.

Figure 7:
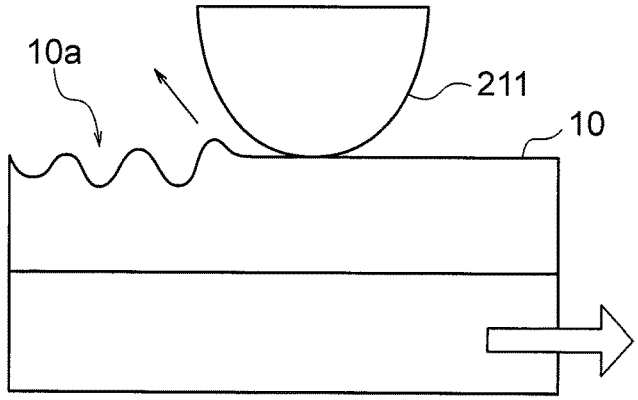
FIG. 7 is a schematic illustrative view showing a relationship between the shoulder portion of FIG. 6 and a coating layer of a Zn coated steel plate.

Next, referring to FIG. 7, a mechanism by which coating residue is generated due to the ironing performed by the shoulder portion 211 will be described. FIG. 7 is a schematic illustrative view showing a relationship between the shoulder portion 211 of FIG. 6 and a coating layer 10 of a Zn coated steel plate. As shown in FIG. 7, minute irregularities 10*a* exist on a surface of the coating layer 10 of the Zn coated steel plate. Without a lubricating film, when the plate surface of the formed portion 1 is ironed by the shoulder portion 211 as shown in FIG. 6, the irregularities 10*a* may be shaved by the shoulder portion 211 so as to form ironing residue.

The amount of generated coating residue correlates with a ratio r/t between a curvature radius r of the shoulder portion 211 and a plate thickness t of the Zn coated steel plate. As the curvature radius r of the shoulder portion 211 decreases, local skewness increases, leading to an increase in sliding resistance between the surface of the coating layer 10 and the shoulder portion 211, and as a result, the amount of generated coating residue increases. Further, as the plate thickness t of the Zn coated steel plate increases, an amount of thinning performed by the shoulder portion 211 increases, leading to an increase in a load exerted on the surface of the Zn coated steel plate, and as a result, the amount of generated coating residue increases. In other words, the amount of generated coating residue increases as the ratio r/t decreases and decreases as the ratio r/t increases. When the coating surface is covered by a lubricating film, on the other hand, sliding resistance between the surface of the coating layer 10 and the shoulder portion 211 decreases, and therefore the ratio r/t at which coating residue is generated takes a smaller value than in a condition where a lubricating film is not provided.

In particular, the plate surface of the pre-ironing formed portion 1 in a position sandwiched between the radius end 211*a* and the punch 20 upon completion of the ironing is thinned to the largest extent by the shoulder portion 211. From the viewpoint of suppressing the amount of generated coating residue, therefore, the amount of generated coating residue correlates strongly with a ratio $r/t_{re}$ between the curvature radius r of the shoulder portion 211 and a plate thickness $t_{re}$ of the pre-ironing formed portion 1 in the position sandwiched between the radius end 211*a* and the punch 20 upon completion of the ironing.

The amount of generated coating residue also correlates with an ironing rate applied by the shoulder portion 211. When a clearance between the radius end 211*a* and the punch 20 is set at $c_{re}$ and the plate thickness $t_{re}$ of the pre-ironing formed portion 1 in the position sandwiched between the radius end 211*a* and the punch 20 upon completion of the ironing is set at $t_{re}$, the ironing rate is expressed by $\{(t_{re}-c_{re})/t_{re}\}\times 100$. The clearance $c_{re}$ corresponds to the plate thickness of the post-ironing formed portion 1 in the position sandwiched between the radius end 211*a* and the punch 20. As the ironing rate increases, the load exerted on the surface of the Zn coated steel plate increases, leading to an increase in the amount of generated coating residue.

Figure 8:
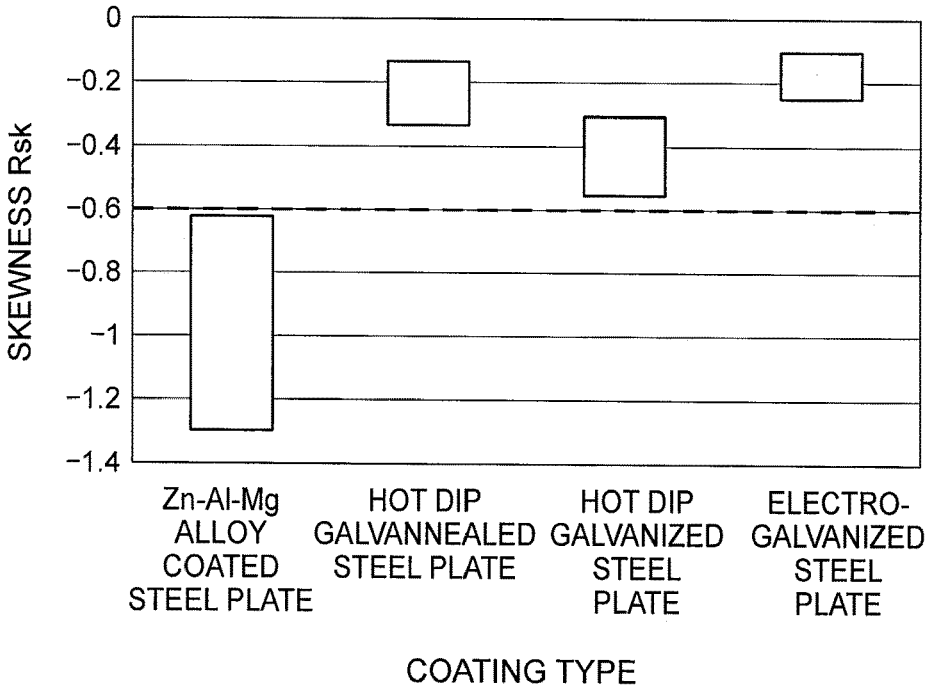
FIG. 8 is a graph showing a skewness Rsk of the coating layer shown in FIG. 6 in relation to various types of coating layers.

FIG. 8 is a graph showing a skewness Rsk of the coating layer 10 shown in FIG. 6 in relation to various types of coating layers. The amount of generated coating residue also correlates with the skewness Rsk of the coating layer 10. The skewness Rsk is defined by Japanese Industrial Standard B0601 and expressed by a following equation.

$$Rsk = \frac{l}{Rq^3}\left\{\frac{l}{l_r}\int_p^{l+} Z^3(x)dx\right\} \quad \text{[Math. 1]}$$

Here, Rq is a root mean square roughness (=a square root of a second moment of an amplitude distribution curve), and $\int Z^3(x)\,dx$ is a third moment of the amplitude distribution curve.

The skewness Rsk represents an existence probability of projecting portions among the irregularities 10*a* (see FIG. 7) on the coating layer 10. As the skewness Rsk decreases, the number of projecting portions decreases, and therefore the amount of generated coating residue is suppressed. Note that the skewness Rsk has been described by the present applicant in Japanese Patent Application Publication 2006-193776.

As shown in FIG. 8, a Zn—Al—Mg alloy coated steel plate, a hot dip galvannealed steel plate, a hot dip galvanized steel plate, and an electro-galvanized steel plate may be cited as types of Zn coated steel plates. A typical Zn—Al—Mg alloy coated steel plate is formed by applying a coating layer constituted by an alloy containing Zn, 6% by weight of Al (aluminum), and 3% by weight of Mg (magnesium) to the surface of a steel plate. As shown in FIG. 8, the present applicant learned, after investigating the respective skewnesses Rsk of these materials, that the skewness Rsk of the Zn—Al—Mg alloy coated steel plate is included within a range of less than −0.6 and no less than −1.3, while the skewnesses Rsk of the other coated steel plates are included within a range of no less than −0.6 and no more than 0.

Next, examples will be described. The inventors performed ironing on a Zn—Al—Mg alloy coated steel plate under following conditions while modifying the ironing rate and $r/t_{re}$. A steel plate not having a lubricating film (a comparative example) and a steel plate having a lubricating film (an example of the invention) were both used as the Zn—Al—Mg alloy coated steel plate. Note that a plate thickness of the Zn—Al—Mg alloy coated steel plate was set at 1.8 mm, and a coating coverage was set at 90 g/m$^2$.

TABLE 1

Chemical composition of sample (% by weight)

| Coating type | C | Si | Mn | P | S | Al | Ti |
|---|---|---|---|---|---|---|---|
| Zn—Al—Mg alloy coated steel plate | 0.002 | 0.006 | 0.14 | 0.014 | 0.006 | 0.032 | 0.056 |

TABLE 2

Mechanical properties of sample

| Coating type | Yield strength (N/mm$^2$) | Tensile strength (N/mm$^2$) | Elongation (%) | Hardness Hv |
|---|---|---|---|---|
| Zn—Al—Mg alloy coated steel plate | 164 | 304 | 49.2 | 87 |

TABLE 3

Experiment conditions

| | |
|---|---|
| Pressing device | 2500 kN Transfer Press |
| Height of pre-ironing formed portion | 10.5 to 13.5 mm |
| Curvature radius r of shoulder portion of forming mold | 1.5 to 4.5 mm |
| Curvature radius r of shoulder portion of ironing mold | 0.3 to 2.0 mm |
| Clearance of ironing mold | 1.10 to 1.80 mm |
| Press forming oil | TN-20 (manufactured by Tokyo Sekiyu Company Ltd.) |

Figure 9:
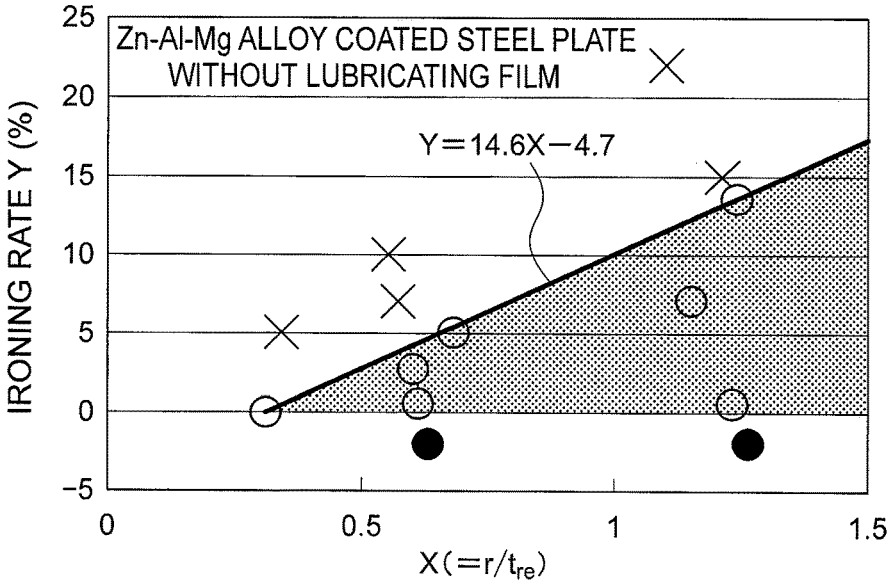
FIG. 9 is a graph showing a relationship between an ironing rate Y and X ($=r/t_{re}$) in relation to a Zn—Al—Mg alloy coated steel plate not having a lubricating film.

FIG. 9 is a graph showing a relationship between the ironing rate Y and X (=$r/t_{re}$) in relation to the Zn—Al—Mg alloy coated steel plate not having a lubricating film. The ordinate in FIG. 9 is the ironing rate, which is expressed by $\{(t_{re}-c_{re})/t_{re}\}\times 100$, and the abscissa is the ratio between the curvature radius r of the shoulder portion 211 and the plate thickness $t_{re}$ of the pre-ironing formed portion 1 in the position sandwiched between the radius end 211*a* and the punch 20 upon completion of the ironing, which is expressed by $r/t_{re}$. Circles show evaluations according to which it was possible to suppress coating residue generation, and crosses show evaluations according to which coating residue generation could not be suppressed. Further, black circles show results according to which the dimensional precision deviated from a predetermined range.

As shown in FIG. 9, in the case of the Zn—Al—Mg alloy coated steel plate, or in other words with a material in which the skewness Rsk is less than −0.6 and no less than −1.3, it was confirmed that coating residue generation can be suppressed in a region below a straight line denoted by $Y=14.6X-4.7$, where Y is the ironing rate and X is $r/t_{re}$. In other words, with a material in which the skewness Rsk is less than −0.6 and no less than −1.3, it was confirmed that coating residue generation can be suppressed by determining the curvature radius r of the shoulder portion 211 and the clearance $c_{re}$ between the radius end 211*a* and the punch 20 so as to satisfy $0<Y\leq 14.6X-4.7$. Note that in the above conditional expression, $0<Y$ is defined so that when the ironing rate Y is equal to or smaller than 0%, ironing is not performed.

Figure 10:
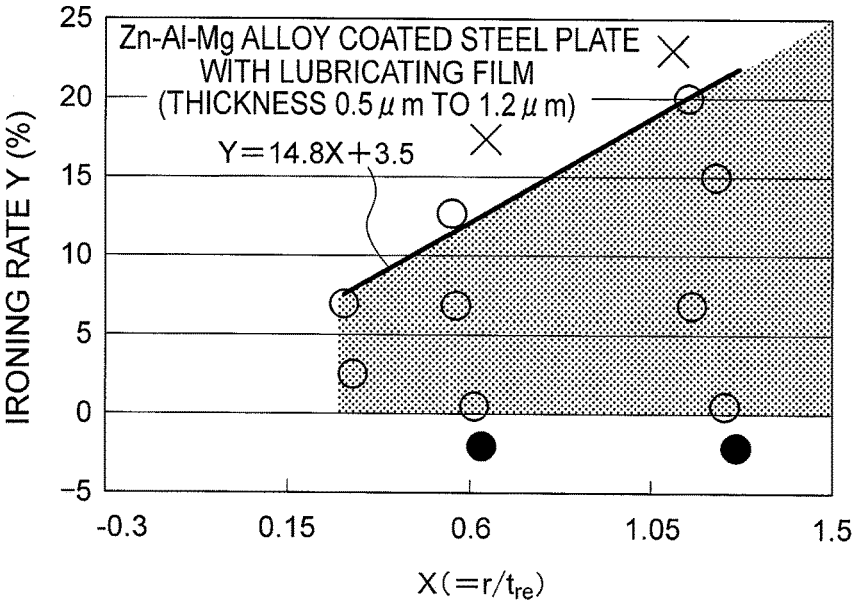
FIG. 10 is a graph showing the relationship between the ironing rate Y and X ($=r/t_{re}$) in relation to a Zn—Al—Mg alloy coated steel plate having a lubricating film with a thickness of no less than 0.5 μm and no more than 1.2 μm.

Next, FIG. 10 is a graph showing the relationship between the ironing rate Y and X ($=r/t_{re}$) in relation to a Zn—Al—Mg alloy coated steel plate having a lubricating film with a thickness of no less than 0.5 μm and no more than 1.2 μm. As shown in FIG. 10, in the case of a Zn—Al—Mg alloy coated steel plate having a lubricating film with a thickness of no less than 0.5 μm and no more than 1.2 μm, it was confirmed that coating residue generation can be suppressed in a region below a straight line denoted by $Y=14.8X+3.5$, where Y is the ironing rate and X is $r/t_{re}$. In other words, it was confirmed that by forming the lubricating film on the surface of the Zn—Al—Mg alloy coated steel plate, coating residue generation can be suppressed over a wider range than when the lubricating film is not formed.

Figure 11:
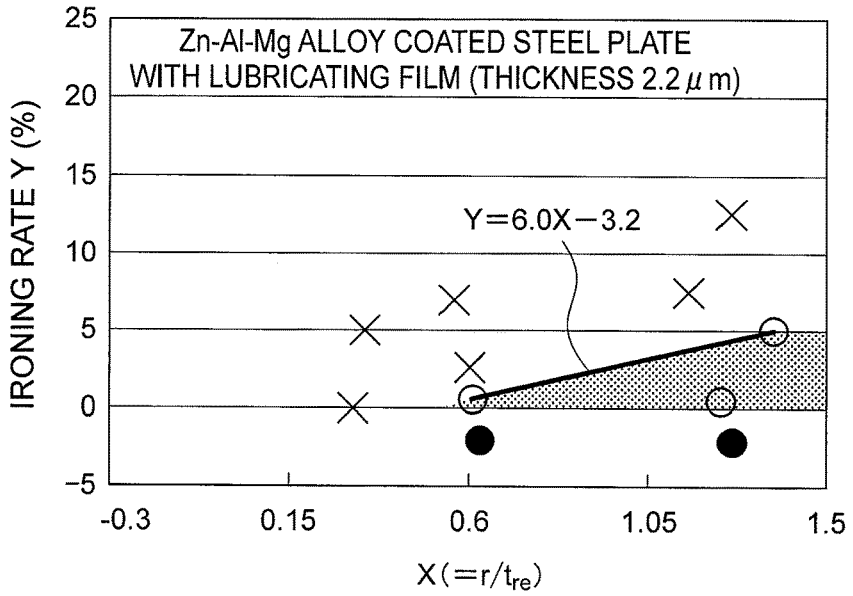
FIG. 11 is a graph showing the relationship between the ironing rate Y and X ($=r/t_{re}$) in relation to a Zn—Al—Mg alloy coated steel plate having a lubricating film with a thickness of 2.2 μm.

Next, FIG. 11 is a graph showing the relationship between the ironing rate Y and X ($=r/t_{re}$) in relation to a Zn—Al—Mg alloy coated steel plate having a lubricating film with a thickness of 2.2 μm. As shown in FIG. 11, in the case of a Zn—Al—Mg alloy coated steel plate having a lubricating film with a thickness of 2.2 μm, it was confirmed that coating residue generation can be suppressed in a region below a straight line denoted by $Y=6.0X-3.2$, where Y is the ironing rate and X is $r/t_{re}$. In other words, it was confirmed that when the thickness of the lubricating film is 2.2 μm, a processing range in which residue generation can be suppressed is narrower than when the lubricating film is not provided. The reason for this is believed to be that when the thickness of the lubricating film increases, the lubricating film itself becomes a source of residue.

Figure 12:
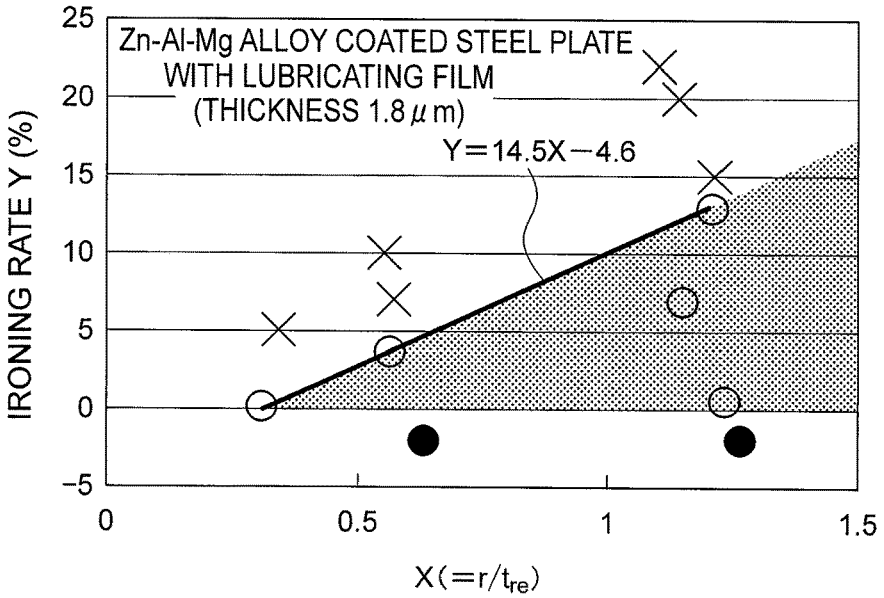
FIG. 12 is a graph showing the relationship between the ironing rate Y and X ($=r/t_{re}$) in relation to a Zn—Al—Mg alloy coated steel plate having a lubricating film with a thickness of 1.8 μm.

Next, FIG. 12 is a graph showing the relationship between the ironing rate Y and X ($=r/t_{re}$) in relation to a Zn—Al—Mg alloy coated steel plate having a lubricating film with a thickness of 1.8 μm. As shown in FIG. 12, in the case of a Zn—Al—Mg alloy coated steel plate having a lubricating film with a thickness of 1.8 μm, it was confirmed that coating residue generation can be suppressed in a region below a straight line denoted by $Y=14.5X-4.6$, where Y is the ironing rate and X is $r/t_{re}$. In other words, it was confirmed that when the thickness of the lubricating film is reduced to 1.8 μm, coating residue generation can be suppressed within a similar range to that of a case in which the lubricating film is not provided.

Figure 13:
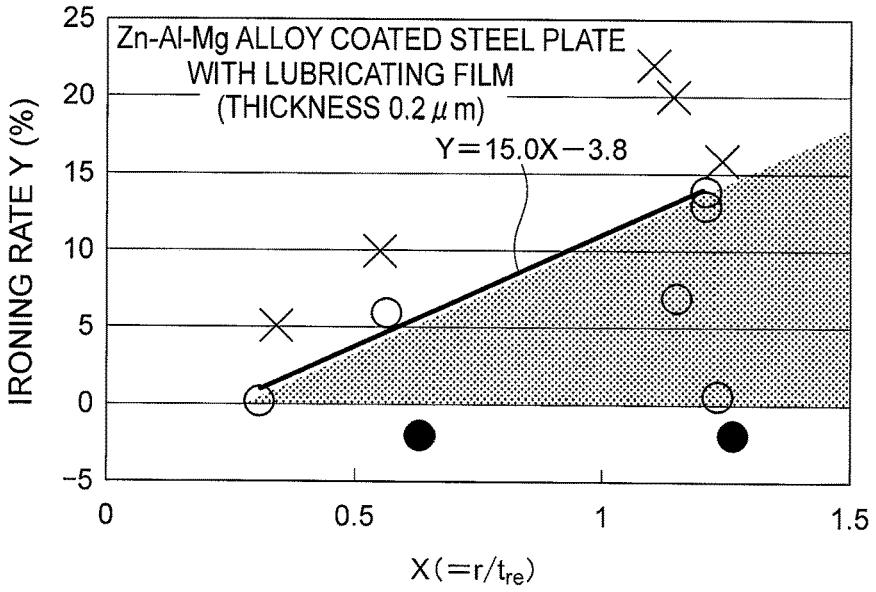
FIG. 13 is a graph showing the relationship between the ironing rate Y and X ($=r/t_{re}$) in relation to a Zn—Al—Mg alloy coated steel plate having a lubricating film with a thickness of 0.2 μm.

Next, FIG. 13 is a graph showing the relationship between the ironing rate Y and X ($=r/t_{re}$) in relation to a Zn—Al—Mg alloy coated steel plate having a lubricating film with a thickness of 0.2 μm. As shown in FIG. 13, in the case of a Zn—Al—Mg alloy coated steel plate having a lubricating film with a thickness of 0.2 μm, it was confirmed that coating residue generation can be suppressed in a region below a straight line denoted by $Y=15.0X-3.8$, where Y is the ironing rate and X is $r/t_{re}$. In other words, it was confirmed that when the thickness of the lubricating film is 0.2 μm, coating residue generation can be suppressed within a similar range to that of a case in which the lubricating film is not provided (FIG. 9). More specifically, it was confirmed that when the thickness of the lubricating film is thicker than 0.2 μm and thinner than 1.8 μm, coating residue generation can be suppressed to a greater extent than when the lubricating film is not provided.

From the results shown in FIGS. 10 to 13, it was confirmed that by setting the thickness of the lubricating film to be thicker than 0.2 μm and thinner than 1.8 μm, the amount of generated powder form residue can be reduced more reliably and under a wider range of processing conditions than when the lubricating film is not provided. Moreover, it was confirmed that by setting the thickness of the lubricating film to be no less than 0.5 μm and no more than 1.2 μm, the amount of generated powder form residue can be reduced even more reliably under an even wider range of processing conditions.

Figure 14:
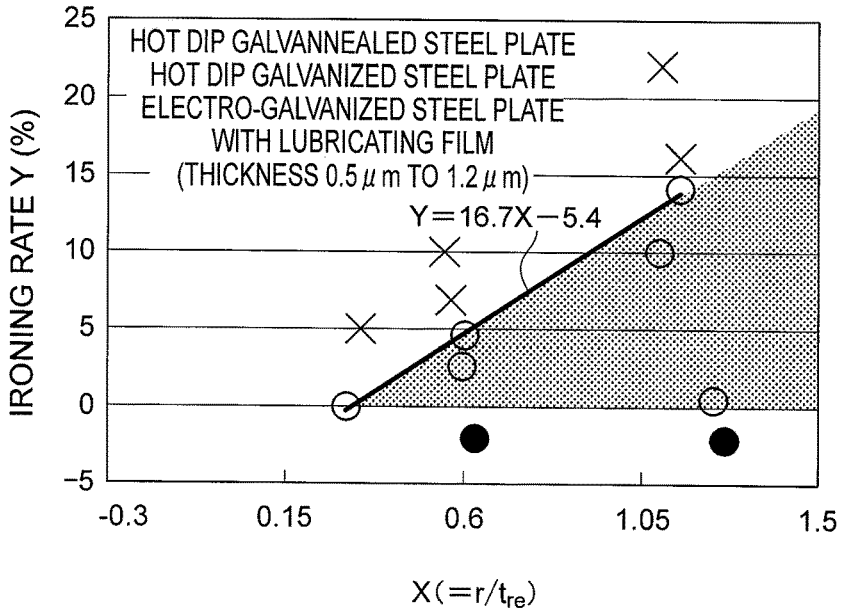
FIG. 14 is a graph showing the relationship between the ironing rate Y and X ($=r/t_{re}$) in relation to a hot dip galvannealed steel plate, a hot dip galvanized steel plate and an electro-galvanized steel plate shown in FIG. 8.

Next, FIG. 14 is a graph showing the relationship between the ironing rate Y and X ($=r/t_{re}$) in a case where a lubricating film having a thickness of no less than 0.5 μm and no more than 1.2 μm is provided on the hot dip galvannealed steel plate, the hot dip galvanized steel plate, and the electro-galvanized steel plate shown in FIG. 8. The present inventors performed a similar experiment under conditions described below in relation to the hot dip galvannealed steel plate, the hot dip galvanized steel plate, and the electro-galvanized steel plate. Note that experiment conditions such as the pressing device (see Table 3) were identical to those of the ironing performed on the Zn—Al—Mg alloy coated steel plate, described above. Further, the hot dip galvannealed steel plate and the hot dip galvanized steel plate had a plate thickness of 1.8 mm and a coating coverage of 90 g/m$^2$, while the electro-galvanized steel plate had a plate thickness of 1.8 mm and a coating coverage of 20 g/m$^2$.

TABLE 4

Chemical composition of samples (% by weight)

| Coating type | C | Si | Mn | P | S | Al | Ti |
|---|---|---|---|---|---|---|---|
| Hot dip galvannealed steel plate | 0.003 | 0.005 | 0.14 | 0.014 | 0.006 | 0.035 | 0.070 |
| Hot dip galvanized steel plate | 0.004 | 0.006 | 0.15 | 0.014 | 0.007 | 0.039 | 0.065 |
| Electro-galvanized steel plate | 0.002 | 0.004 | 0.13 | 0.013 | 0.008 | 0.041 | 0.071 |

TABLE 5

Mechanical properties of samples

| Coating type | Yield strength (N/mm$^2$) | Tensile strength (N/mm$^2$) | Elongation (%) | Hardness Hv |
|---|---|---|---|---|
| Hot dip galvannealed steel plate | 175 | 315 | 46.2 | 89 |
| Hot dip galvanized steel plate | 178 | 318 | 45.7 | 90 |
| Electro-galvanized steel plate | 159 | 285 | 53.4 | 84 |

As shown in FIG. 14, in a case where a lubricating film having a thickness of no less than 0.5 μm and no more than 1.2 μm is provided on the hot dip galvannealed steel plate, the hot dip galvanized steel plate, and the electro-galvanized steel plate, or in other words in the case of a material in which the skewness Rsk is no less than −0.6 and no more than 0, it was confirmed that coating residue generation can be suppressed in a region below a straight line denoted by $Y=16.7X-5.4$, where Y is the ironing rate and X is $r/t_{re}$. In other words, when a lubricating film having a thickness of no less than 0.5 μm and no more than 1.2 μm is provided on a material in which the skewness Rsk is no less than −0.6 and no more than 0, it was confirmed that coating residue generation can be suppressed by determining the curvature radius r of the shoulder portion 211 and the clearance $c_{re}$ between the radius end 211*a* and the punch 20 so as to satisfy $0<Y\leq 16.7X-5.4$.

Hence, in the ironing mold 2 and the formed material manufacturing method described above, to ensure that the amount of ironing applied to the formed portion 1 remains constant in the pushing direction 1*c*, the inner peripheral surface 212 is provided with the clearance 212*a* that corresponds to the uneven plate thickness distribution, in the pushing direction 1*c*, of the formed portion 1 prior to ironing relative to the outer peripheral surface 20*a* of the punch 20, and therefore generation of a large load in a part of the surface can be avoided, with the result that the amount of generated powder form residue can be reduced. By reducing the amount of generated powder form residue, problems such as formation of minute pockmarks (dents) in the surface of the ironed formed portion 1, deterioration of the performance of a product manufactured using the formed material, and the need for an operation to remove the powder form residue can be eliminated. This configuration is particularly effective when ironing is performed on a Zn coated steel plate.

Further, the thickness of the lubricating film is set to be thicker than 0.2 μm and thinner than 1.8 μm, and therefore the amount of generated powder form residue can be reduced more reliably under a wider range of processing conditions.

Moreover, the thickness of the lubricating film is set to be no less than 0.5 μm and no more than 1.2 μm, and therefore the amount of generated powder form residue can be reduced even more reliably under an even wider range of processing conditions.

The invention claimed is:

1. A formed material manufacturing method, comprising the steps of:

forming a convex formed portion by performing at least one forming process on a surface treated metal plate; and performing ironing on the formed portion using an ironing mold after forming the formed portion, wherein the surface treated metal plate includes a surface treated layer provided on a surface of the metal plate, and a lubricating film provided on a surface of the surface treated layer, wherein the ironing mold includes a punch that is inserted into the formed portion, and a die having a pushing hole into which the formed portion is pushed together with the punch, wherein the pushing hole includes a shoulder portion disposed on an outer edge of an inlet of the pushing hole and comprising a curved surface having a predetermined curvature radius, and an inner peripheral surface which extends from a radius end of the shoulder portion in a pushing direction of the formed portion, and along which an outer surface of the formed portion slides in response to relative displacement between the punch and the die, and wherein the inner peripheral surface extends non-parallel to an outer peripheral surface of the punch, and the inner peripheral surface is provided with a clearance that corresponds to an uneven plate thickness distribution, in the pushing direction, of the formed portion prior to the ironing relative to the outer peripheral surface to ensure that an amount of ironing applied to the formed portion remains constant in the pushing direction, and wherein a substantial length of the inner peripheral surface of the pushing hole in the pushing direction faces the outer peripheral surface of the punch when the punch reaches a completion position in the ironing step so that a substantially entire length of the formed portion defined between a base portion of the formed portion and an apex portion of the formed portion is disposed between the inner peripheral surface of the pushing hole and the outer peripheral surface of the punch.

2. The formed material manufacturing method according to claim 1, wherein a thickness of the lubricating film is set to be thicker than 0.2 μm and thinner than 1.8 μm.

3. The formed material manufacturing method according to claim 2, wherein the thickness of the lubricating film is set to be no less than 0.5 μm and no more than 1.2 μm.

* * * * *